US009404171B2

(12) United States Patent
Hamaya et al.

(10) Patent No.: US 9,404,171 B2
(45) Date of Patent: Aug. 2, 2016

(54) RARE EARTH OXIDE-CONTAINING SPRAYED PLATE AND MAKING METHOD

(75) Inventors: Noriaki Hamaya, Tokyo (JP); Koji Nakamura, Tokyo (JP); Ryoji Iida, Tokyo (JP)

(73) Assignee: SHIN-ETSU CHEMICAL CO., LTD., Tokyo (JP)

( * ) Notice: Subject to any disclaimer, the term of this patent is extended or adjusted under 35 U.S.C. 154(b) by 0 days.

(21) Appl. No.: 12/122,947

(22) Filed: May 19, 2008

(65) Prior Publication Data

US 2009/0324916 A1 Dec. 31, 2009

(30) Foreign Application Priority Data

May 21, 2007 (JP) ..... 2007-133669

(51) Int. Cl.

| | |
|---|---|
| ***B32B 5/00*** | (2006.01) |
| ***C23C 4/06*** | (2016.01) |
| ***C23C 4/18*** | (2006.01) |

(52) U.S. Cl.

CPC ... *C23C 4/06* (2013.01); *C23C 4/11* (2016.01); *C23C 4/185* (2013.01); *Y10T 428/26* (2015.01)

(58) Field of Classification Search

USPC ..... 428/220, 332; 264/309; 427/453

See application file for complete search history.

(56) References Cited

U.S. PATENT DOCUMENTS

| | | | | |
|---|---|---|---|---|
| 3,429,962 | A | 2/1969 | Krystyniak | |
| 3,645,894 | A | 2/1972 | Krystyniak | |
| 4,713,284 | A | 12/1987 | Hasegawa | |
| 5,304,519 | A * | 4/1994 | Jackson et al. | 501/103 |
| 7,056,467 | B2 | 6/2006 | Kang et al. | |
| 7,157,148 | B2 * | 1/2007 | Takai et al. | 428/469 |
| 7,906,219 | B2 | 3/2011 | Ohara et al. | |
| 2004/0071896 | A1 | 4/2004 | Kang et al. | |
| 2004/0110016 | A1 * | 6/2004 | Hamaya et al. | 428/472 |
| 2007/0077456 | A1 | 4/2007 | Kitamura et al. | |
| 2008/0035898 | A1 * | 2/2008 | Tsuchiya et al. | 252/600 |

FOREIGN PATENT DOCUMENTS

| | | | |
|---|---|---|---|
| DE | 4225779 | A1 | 2/1994 |
| EP | 185430 | A1 * | 6/1986 |
| EP | 0794265 | A2 | 9/1997 |
| EP | 1428904 | A2 | 6/2004 |
| EP | 1435501 | A1 | 7/2004 |
| JP | 61-030658 | A | 2/1986 |
| JP | 61037955 | A * | 2/1986 |
| JP | 61124534 | A * | 6/1986 |
| JP | 02-148790 | A | 6/1990 |
| JP | 4-506336 | A | 11/1992 |
| JP | 06-033215 | A | 2/1994 |
| JP | 09-246605 | A | 9/1997 |
| JP | 10-204655 | A | 8/1998 |
| JP | 2001-207252 | A | 7/2001 |
| JP | 2004-003022 | A | 1/2004 |
| JP | 2004-100045 | A | 4/2004 |
| JP | 2004-346374 | A | 12/2004 |
| JP | 2004346374 | A * | 12/2004 |
| JP | 2006-21400 | A | 8/2006 |
| JP | 2007-100142 | A | 4/2007 |
| JP | 2007-100143 | A | 4/2007 |
| WO | 91/00934 | A1 | 1/1991 |

OTHER PUBLICATIONS

Machine English Translation of JP_2004/346374_A, Koyata Takahashi, Method for Peeling Off Sprayed Coating, and Method for Manufacturing Member Coated With Sprayed Coating, Dec. 9, 2004; JPO.*

English Abstract + Derwent Abstract_JP_61037955_A; Terai, Atsushi; Roll for Molten Metal Bath; Feb. 22, 1986; JPO.*

English Abstract + Derwent Abstract_JP_61124534_A; Tamura, Shinichi; Roll for Heat Treating Furnace; Jun. 12, 1986; JPO.*

European Search Report dated Oct. 4, 2011, issued in corresponding European Patent Application No. 08009114.3.

Japanese Office Action dated Aug. 31, 2011, issued in corresponding Japanese Patent Application No. 2007-133669.

Japanese Office Action dated Jun. 13, 2012, issued in corresponding Japanese Patent Application No. 2007-133669 (3 pages).

Japanese Office Action dated Dec. 14, 2011, issued in corresponding Japanese Patent Application No. 2007-133669 (3 pages).

Japanese Office Action dated Jan. 7, 2014, issued in corresponding Japanese Patent Application No. 2012-042710.

* cited by examiner

*Primary Examiner* — Tahseen N Khan

(74) *Attorney, Agent, or Firm* — Westerman, Hattori, Daniels & Adrian, LLP

(57) ABSTRACT

A rare earth oxide-containing sprayed plate is prepared by thermally spraying a rare earth oxide on a support to a thickness of up to 5 mm and peeling the sprayed coating from the support. Thin plates of rare earth oxide ceramics can be prepared without molding, firing and sintering steps.

21 Claims, No Drawings

RARE EARTH OXIDE-CONTAINING SPRAYED PLATE AND MAKING METHOD

CROSS-REFERENCE TO RELATED APPLICATION

This non-provisional application claims priority under 35 U.S.C. §119(a) on Patent Application No. 2007-133669 filed in Japan on May 21, 2007, the entire contents of which are hereby incorporated by reference.

TECHNICAL FIELD

This invention relates to sprayed thin plates of various rare earth oxide-containing ceramics and a method for preparing the same.

BACKGROUND ART

Rare earth-based oxide ceramics are generally prepared by molding methods including mold pressing, rubber pressing (or isostatic pressing), slip casting, and doctor blade methods. There is furnished rare earth-based oxide powder. Ceramic compacts are shaped from the powder by any of these molding methods. The compacts are subjected to firing, sintering and working steps until they are finished into products of the predetermined size.

However, where it is desired to prepare rare earth-based oxide ceramic thin plates, especially thin plates having a thickness of up to 5 mm and a volume of at least 50 $cm^3$, by the molding method, cracks occur during the molding step, which makes it difficult to obtain molded compacts. One common solution to this problem involves molding compacts having a greater thickness so as to ensure higher yields of compact formation, firing and sintering the compacts, and grinding or otherwise machining the compacts into thin plates having a thickness of up to 5 mm.

This method, however, is disadvantageous in that as the final thin plate becomes thinner in thickness or greater in volume, the method requires a more amount of source material and a longer time for product finishing. Because of cracking and warpage during sintering, the yield of overall manufacture is substantially reduced, resulting in an increased cost. This is a problem in the manufacture of ceramic thin plates.

For the related technology, reference should be made to patents including JP-A 10-204655, JP-A 6-33215, JP-A 2004-346374, and JP-B 6-55477.

DISCLOSURE OF THE INVENTION

An object of the invention is to provide thin plates of rare earth-based oxide ceramics which are used as equipment members requiring inertness, heat resistance, abrasion resistance, corrosion resistance, plasma resistance and chemical resistance; and a method of preparing the thin plates of rare earth-based oxide ceramics in a simple manner.

The inventors have found that a thin plate of rare earth-based oxide ceramic which is substantially flat with minimized warpage or deflection can be prepared by thermally spraying a rare earth-based oxide ceramic on a selected support, and peeling the sprayed rare earth-based oxide ceramic coating from the support. Typically the sprayed coating spontaneously peels from the support. Any warpage of the sprayed coating can be corrected by further thermally spraying a ceramic to the inner (peeled) surface of the sprayed coating, and optionally, alternately thermally spraying a ceramic to the inner and outer surfaces of the sprayed coating until the predetermined thickness is reached.

In one aspect, the invention provides a sprayed plate comprising a rare earth oxide and having a thickness of up to 5 mm.

Also provided is a laminate comprising the plate and a layer of a metal or metal compound lying thereon.

In another aspect, the invention provides a method for preparing a rare earth oxide-containing sprayed plate, comprising thermally spraying a rare earth-based oxide on a support to form a coating having a thickness of up to 5 mm, and peeling the sprayed coating from the support. Typically the support comprises carbon. Most often, the peeling step is spontaneous peeling. The sprayed coating peeled from the support has an inner surface as peeled from the support and an outer surface remote therefrom. The method may further comprise the step of thermally spraying a rare earth-based oxide on the inner and/or outer surface of the sprayed coating.

The invention further provides a method for preparing a laminate, comprising thermally spraying a metal or metal compound on a surface of the sprayed plate obtained by the above method.

BENEFITS OF THE INVENTION

According to the invention, thin plates of rare earth-based oxide ceramics can be prepared by thermal spraying on a support of selected size, without molding, firing and sintering steps. A choice of a proper support shape makes it possible and easy to prepare thin plates of different shapes including polygonal, disc, ring and triangular shapes. By spraying on a support with a plurality of holes, a sprayed thin plate having a plurality of holes can be prepared.

In the preferred embodiment, rare earth-based oxide particles are sprayed on a carbon support to form a coating. The sprayed rare earth-based oxide coating spontaneously peels from the support. Thereafter, thermal spraying is continued on the inner surface of the sprayed coating that is exposed as a result of peeling. A rare earth-based oxide ceramic thin plate with minimized warpage or deflection can thus be manufactured.

The thin plates of rare earth-based oxide ceramics find use as equipment members in many fields where inertness, heat resistance, abrasion resistance, corrosion resistance, plasma resistance and chemical resistance are required. The invention is applicable to commercially available general oxide ceramic powders as well as the rare earth-based oxide ceramic powders.

DESCRIPTION OF THE PREFERRED EMBODIMENT

The terms "a" and "an" herein do not denote a limitation of quantity, but rather denote the presence of at least one of the referenced item. The terms "inner," "outer," and the like are used herein to distinguish one element from another.

The sprayed plate comprising rare earth oxide according to the invention has a thickness of up to 5 mm, preferably up to 4 mm, more preferably up to 3.5 mm, and even more preferably up to 2.5 mm. A minimum thickness of at least 0.2 mm, and especially at least 0.5 mm is preferred from the aspect of preventing the plate from being damaged by handling.

The shape of the sprayed plate is not particularly limited. The sprayed plate may have any desired shape, for example, tetragonal, pentagonal and polygonal shapes, disc shapes, elliptic shapes, triangular shapes, and rings of these shapes having a center opening. The plate should preferably have a volume of at least 50 $cm^3$, more preferably at least 100 $cm^3$, and even more preferably at least 200 $cm^3$. The upper limit of volume is not critical although a volume of up to 2,000 $cm^3$, and especially up to 1,000 $cm^3$ is preferred from the aspect of preventing the plate from being damaged by handling.

The rare earth oxides used herein include oxides of yttrium (Y) and lanthanoids, specifically oxides of elements selected from yttrium (Y) and rare earth elements having atomic number 57 to 71, which may be used alone or in admixture. The preferred rare earth oxides are oxides of Y and Er. Also a mixture of a rare earth oxide with an oxide of another metal, typically Group 3B metal element is useful as well as a complex oxide of a rare earth oxide and an oxide of another metal, typically Group 3B metal element. Exemplary of the Group 3B metal are B, Al, Ga, In, and Ti elements.

Where a mixture or a complex oxide of a rare earth oxide and another metal oxide is used, the content of rare earth oxide is 10% to 90% by weight, and preferably 30% to 80% by weight based on the total weight of rare earth and other metal oxides. The coating on the support prior to peeling may consist of more than one rare earth oxide layer.

In preparing the sprayed plate (or rare earth-based oxide ceramic thin plate), there are furnished a support of selected shape and size and a powdered source of rare earth-based oxide to be sprayed.

The support may be formed of any material including metals, ceramics, and carbon. Among others, carbon supports are preferred because the sprayed coating is releasable therefrom. Carbon supports are available as cold isostatic pressed (CIP) members, extruded members, molded members, and composite members of consolidated fibrous carbon, with the CIP members being preferred.

The powdered sources to be sprayed include the rare earth oxides described above, and mixtures and complexes of the rare earth oxides with other metal oxides, especially Group 3B metal oxides, in powdered form. The powder preferably has an average particle size of 3 μm to 70 μm, and more preferably 15 μm to 60 μm. The average particle size as used herein is a $D_{50}$ value (non-variance) as determined by the microtrack method.

In the method of the invention, the powdered source is thermally sprayed onto the support. Prior to the spraying, the support of selected shape is surface treated by blasting or similar technique, if necessary. The support of selected shape corresponds to a mold used in the standard ceramic molding step. The support, once prepared, may be repeatedly used.

Once the support is prepared, the powdered source is sprayed thereon. The type of thermal spraying is not particularly limited although plasma spraying is preferred. Under preferred thermal spraying conditions including argon and hydrogen gases, a current flow of 500 amperes, and a power of 35 kW, a sprayed coating is deposited on the support.

When the coating deposited on the support by spraying reaches a certain thickness, the coating spontaneously peels from the support. The spontaneous peeling takes place by virtue of thermal stresses arising from the difference between the shape (size, thickness, etc.), physical properties (coefficient of thermal expansion, modulus, etc.) and the surface state as blasted of the support and the physical properties (coefficient of thermal expansion, modulus, etc.) of the sprayed coating. The desired thin plate may be obtained either by utilizing the spontaneous peeling force of the sprayed coating from the support or by positive mechanical peeling. In the case of a large size support, if the material, thickness and surface state of the support do not match with the sprayed coating, cracks develop in the coating when it spontaneously peels from the support. Then the desired thin plate is not available. The thickness of the sprayed coating when it spontaneously peels from the support largely varies with the material, shape, thickness and surface state of the support and the type of the sprayed coating. Typically spontaneous peeling occurs when the sprayed coating reaches a thickness of 1 mm or more.

It is noted that the sprayed coating, when peeled from the support, has an inner surface which is exposed as a result of peeling and an outer surface remote therefrom. After peeling, the inner surface of the sprayed coating may have residues of the support material carried thereon. Such residues may be removed by suitable techniques including blasting, polishing, chemical treatment and firing treatment.

The sprayed coating which has spontaneously peeled from the support may have some deformation (warpage or deflection) introduced by thermal stresses. Such deformation can be avoided by tailoring the support shape. Such deformation can also be corrected by heat treatment or by applying additional coating to the inner surface of the sprayed coating which is exposed as a result of spontaneous peeling, and preferably by providing additional coating layers by thermal spraying. The heat treatment for correction may be at 800° C. to 1700° C. for 1 to 10 hours.

By applying an additional coating to the inner surface of the sprayed coating, the deformation by thermal stress is corrected accordingly and eventually to substantially zero when the additional coating reaches a certain thickness. From the point of time when deformation or warpage is eliminated, thermal spraying can be further continued alternately on the inner and outer surfaces of the sprayed coating until the thin plate reaches the predetermined thickness. The material to be deposited on the inner surface is not particularly limited, and suitable materials include the powdered source of rare earth oxide to be sprayed, metals, metal compounds, and resins. Since thin plates often have more or less warpage, it is advantageous to apply additional layers by thermal spraying for correcting the warpage. Additional layers can be deposited on the sprayed plate by other methods including sputtering, plating, and evaporation. The additional multilayer coating may have a thickness of about 0.01 mm to about 5 mm though the thickness is not limited thereto.

The metals, metal compounds, and resins used in the additional layers include, but are not limited to, Al, Fe, W, Si, Mo, Ti, Ni, Cu, stainless steel, titania, alumina, zirconia, WC, SiC, $SiO_2$, silicon nitride, rare earth oxides, rare earth fluorides, rare earth nitrides, complex oxides such as YAG and YIG, epoxy resins, acrylic resins, silicone resins, and polyimide resins. Lamination of rare earth compounds is preferred for adherence.

Depending on the intended application, the resulting rare earth oxide thin plate may be used as such or worked prior to use. Namely, the thin plate may be worked, for example, by cutting, machining, grinding, or mirror polishing, whereby it is finished to the desired shape and surface state so that it is ready for use.

As a variant of the method, a thin plate having alternately deposited layers of different oxides can be manufactured. For example, a thin plate having 200-μm thick layers of yttrium oxide and erbium oxide alternately deposited to a total thickness of about 3 mm can be manufactured. It is also possible that a layer of an element or compound (e.g., metal) different from the rare earth oxide intervene between thermally sprayed coatings. The invention enables to manufacture rare earth oxide composite thin plates which could not be manufactured by the standard ceramic molding techniques. In the application where a high purity is required, thin plates of high purity can be manufactured by using the carbon support and the powdered source to be sprayed of high purity, conducting thermal spraying in a clean environment, and effecting post-treatment such as acid washing, alkali washing, organic solvent washing, heat treatment, or precision cleaning.

The plate manufactured by the invention is advantageously used as members (which must be plasma resistant) in semiconductor device processing chambers, laminate members having an electrode pattern of tungsten or the like formed therein and capable of producing an electrostatic force such as members in electrostatic chucks, and setters used in sintering of magnet alloys.

EXAMPLE

Examples of the invention are given below by way of illustration, but not by way of limitation.

Example 1

There was furnished a CIP carbon support of 250×250×5 mm. Prior to plasma spraying, the surface of the support was roughened by blasting. Then a powdered source for $Y_2O_3$ spraying was plasma sprayed in an atmosphere of argon and hydrogen. When the sprayed $Y_2O_3$ coating reached a thickness of 1.2 mm, it spontaneously peeled from the support. A $Y_2O_3$ ceramic thin plate was obtained. By measurement using a clearance gauge, the thin plate was found to have a warpage of more than 1 mm at opposite ends. To correct the warpage, thermal spraying was continued on the inner (peeled) surface of the $Y_2O_3$ thin plate until the additional coating built up 0.8 mm thick. There was obtained a $Y_2O_3$ ceramic thin plate of 250×250×2 mm which showed a minimized warpage of less than 0.5 mm.

It is noted that the warpage of a sprayed thin plate was measured as follows. The sprayed thin plate was rested on a marble table. If the plate is rectangular, the clearance gauge is applied to the rectangular plate at twelve points spaced clockwise along the outer periphery thereof (3 points on one side) to measure a warpage. After measurement on the front surface, the plate is turned up side down, and measurement is performed on the rear surface again. An average of all measurements is reported as a warpage. If the plate is circular, the clearance gauge is applied to the disc at eight points spaced clockwise along the outer periphery thereof to measure a warpage. After measurement on the front surface, the disc is turned up side down, and measurement is performed on the rear surface again. An average of all measurements is reported as a warpage.

Example 2

There was furnished a CIP carbon support of 400 mm diameter and 20 mm thick. Prior to plasma spraying, the support surface was roughened by blasting. Then a powdered source for $Y_2O_3$ spraying was plasma sprayed in an atmosphere of argon and hydrogen. When the sprayed $Y_2O_3$ coating reached a thickness of 1.5 mm, it spontaneously peeled from the support. A $Y_2O_3$ ceramic thin disc was obtained. By measurement using a clearance gauge, the thin disc was found to have a warpage of more than 3 mm at diametrically opposite ends. To correct the warpage, thermal spraying was continued on the inner (peeled) surface of the $Y_2O_3$ thin disc until the additional coating built up 1.0 mm thick. There was obtained a $Y_2O_3$ ceramic thin disc of 400 mm diameter and 2.5 mm thick which showed a minimized warpage of less than 0.5 mm. After the warpage correction, thermal spraying was continued alternately on the inner and outer surfaces of the disc, yielding a $Y_2O_3$ ceramic thin disc of 400 mm diameter and 3.5 mm thick. By subsequent surface grinding, the disc was finished into a $Y_2O_3$ ceramic thin disc of 400 mm diameter and 2.5 mm thick and having a warpage of 0 mm.

Example 3

There was furnished a CIP carbon ring support having an outer diameter 400 mm, an inner diameter 200 mm and a thickness 5 mm. Prior to plasma spraying, the support surface was roughened by blasting. Then a powdered source for YAG spraying was plasma sprayed in an atmosphere of argon and hydrogen. When the sprayed YAG coating reached a thickness of 1.3 mm, it spontaneously peeled from the support. A YAG ceramic thin ring was obtained. By measurement using a clearance gauge, the thin ring was found to have a warpage of more than 2 mm at opposite ends. To correct the warpage, thermal spraying was continued on the inner (peeled) surface of the YAG thin ring until the additional coating built up 0.7 mm thick. There was obtained a YAG ceramic thin ring having an outer diameter 400 mm, an inner diameter 200 mm and a thickness 2 mm which showed a minimized warpage of less than 1 mm.

Comparative Example 1

There was furnished a metal mold of 250×250 mm square. The mold was filled with a powdered source for $Y_2O_3$ pressing. In an attempt to form a molded body of 2 mm thick, the press was forced while adjusting the cavity. Upon removal from the mold, the molded body cracked, indicating a failure to produce a molded body of 250×250 mm square.

Comparative Example 2

There was furnished a neoprene rubber mold of 400 mm diameter and 10 mm depth. The rubber mold was filled with a powdered source for $Y_2O_3$ pressing. Using an isostatic press, the material was molded under a hydraulic pressure of 2 ton/cm$^2$. A molded body of 400 mm diameter and 8 mm thick was obtained while its circumferential edge partially chipped. The molded body had so low a strength that it cracked due to warpage during subsequent sintering, indicating a failure to manufacture a sintered rare earth oxide ceramic disc having a diameter of 400 mm.

Example 4

There was furnished a CIP carbon support of 400 mm diameter and 20 mm thick. Prior to plasma spraying, the support surface was roughened by blasting. Then a powdered source for $Er_2O_3$ spraying was plasma sprayed in an atmosphere of argon and hydrogen. When the sprayed $Er_2O_3$ coating reached a thickness of 1.2 mm, it spontaneously peeled from the support. A $Er_2O_3$ thin disc was obtained. By measurement using a clearance gauge, the thin disc was found to have a warpage of more than 3 mm at opposite ends. To correct the warpage, thermal spraying was continued on the inner (peeled) surface of the $Er_2O_3$ thin disc. The powdered source for additional spraying was tungsten powder. When the tungsten coating built up 0.7 mm thick, there was obtained a $Er_2O_3$/tungsten thin disc of 400 mm diameter and 1.9 mm thick which showed a minimized warpage of less than 0.5 mm.

Example 5

There was furnished a CIP carbon support of 400 mm diameter and 20 mm thick. Prior to plasma spraying, the support surface was roughened by blasting. Then a powdered source for $Y_2O_3$ spraying was plasma sprayed in an atmosphere of argon and hydrogen. When the sprayed coating built up 200 μm thick, the source was changed to a powdered source for $Er_2O_3$ spraying, which was sprayed under the same conditions to a buildup of 200 μm. In this way, alternate spraying of $Y_2O_3$ and $Er_2O_3$ each to a buildup of 200 μm was continued. When the sprayed $Y_2O_3/Er_2O_3$ coating reached a thickness of 1.4 mm, it spontaneously peeled at the interface between the carbon support and $Y_2O_3$. A multilayer $Y_2O_3/Er_2O_3$ ceramic thin disc was obtained. By measurement using a clearance gauge, the thin disc was found to have a warpage of more than 2 mm at opposite ends. To correct the warpage, spraying of alternate $Y_2O_3$ and $Er_2O_3$ layers was continued on the inner (peeled) surface of the $Y_2O_3/Er_2O_3$ thin disc until the additional coating built up 1.0 mm thick. There was obtained a ceramic thin disc of alternate $Y_2O_3/Er_2O_3$ layers of 400 mm diameter and 2.4 mm thick which showed a minimized warpage of less than 0.5 mm. After the warpage correction, the disc was cut into two for sectional observation. The cut section was observed under a microscope, finding a multilayer structure consisting of $Y_2O_3$ layers of about 200 μm thick and $Er_2O_3$ layers of about 200 μm thick.

Example 6

There was furnished a CIP carbon support of 400 mm diameter and 20 mm thick. Prior to plasma spraying, the support surface was roughened by blasting. Then a powdered source for $Y_2O_3$ spraying was plasma sprayed in an atmosphere of argon and hydrogen. When the sprayed coating built up 800 μm thick, a mask for forming an electrode pattern was applied. A powdered source for tungsten spraying was sprayed over the mask to deposit a tungsten layer of about 200 μm thick. Only the electrode terminal portions were left, the source was changed to $Y_2O_3$, and spraying was effected again. When the sprayed ($Y_2O_3$+tungsten) coating reached a thickness of 1.4 mm, it spontaneously peeled from the support. A tungsten-buried $Y_2O_3$ ceramic thin disc was obtained. By measurement using a clearance gauge, the thin disc was found to have a warpage of more than 4 mm at opposite ends. To correct the warpage, $Y_2O_3$ spraying was continued on the inner (peeled) surface of the tungsten-buried $Y_2O_3$ thin disc until the additional coating built up 0.8 mm thick. There was obtained a tungsten electrode-buried $Y_2O_3$ ceramic thin disc of 400 mm diameter and 2.2 mm thick which showed a minimized warpage of less than 0.5 mm.

Example 7

There was furnished a CIP carbon support of 400 mm diameter and 20 mm thick. Prior to plasma spraying, the support surface was roughened by blasting. Then a powdered source for $Y_2O_3$ spraying was plasma sprayed in an atmosphere of argon and hydrogen. When the sprayed $Y_2O_3$ coating reached a thickness of 1.5 mm, it spontaneously peeled from the support. A $Y_2O_3$ ceramic thin disc was obtained. By measurement using a clearance gauge, the thin disc was found to have a warpage of more than 3 mm at opposite ends. To correct the warpage, thermal spraying was continued on the inner (peeled) surface of the $Y_2O_3$ thin disc, using yttrium fluoride ($YF_3$) powder as the source. When the additional coating was deposited to a thickness of 1.0 mm, there was obtained a $Y_2O_3/YF_3$ ceramic thin disc of 400 mm diameter and 2.5 mm thick which showed a minimized warpage of less than 0.5 mm.

Example 8

There was furnished a CIP carbon support of 400 mm diameter and 20 mm thick. Prior to plasma spraying, the support surface was roughened by blasting. Then a powdered source for $Y_2O_3$ spraying was plasma sprayed in an atmosphere of argon and hydrogen. When the sprayed $Y_2O_3$ coating reached a thickness of 1.5 mm, it spontaneously peeled from the support. A $Y_2O_3$ ceramic thin disc was obtained. By measurement using a clearance gauge, the thin disc was found to have a warpage of more than 3 mm at opposite ends. To correct the warpage, thermal spraying was continued on the inner (peeled) surface of the $Y_2O_3$ thin disc, using an alumina ($Al_2O_3$) powder as the source. When the additional coating was deposited to a thickness of 0.5 mm, there was obtained a $Y_2O_3/Al_2O_3$ ceramic thin disc of 400 mm diameter and 2.0 mm thick which showed a minimized warpage of less than 0.5 mm.

Example 9

There was furnished a CIP carbon support of 400 mm diameter and 5 mm thick. Prior to plasma spraying, the support surface was roughened by blasting. Then a powdered source for $Y_2O_3$ spraying was plasma sprayed in an atmosphere of argon and hydrogen. When the sprayed $Y_2O_3$ coating reached a thickness of 0.9 mm, it spontaneously peeled from the support. A $Y_2O_3$ ceramic thin disc was obtained. By measurement using a clearance gauge, the thin disc was found to have a warpage of more than 10 mm at opposite ends. The $Y_2O_3$ thin disc was heat treated in an oxidizing atmosphere furnace in order to remove carbon deposits on the inner (peeled) surface of the disc and to correct the warpage. By the heat treatment, the warpage was corrected to less than 0.5 mm. On the inner and outer surfaces of the $Y_2O_3$ thin disc which had been corrected for warpage, thermal spraying of $Y_2O_3$ was continued. There was obtained a $Y_2O_3$ thin disc of 400 mm diameter and 2 mm thick which showed a minimized warpage of less than 0.5 mm.

Japanese Patent Application No. 2007-133669 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A plate consisting of one or more thermally sprayed layers comprising 30 weight % or more rare earth oxide, wherein the plate has a thickness from 2.0 mm to 5 mm and a warpage of less than 0.5 mm, wherein the plate has a shape selected from the group consisting of tetragonal, pentagonal and polygonal shapes, disc shapes, elliptic shapes, triangular shapes, and rings of these shapes having a center opening, and having a volume of 50 to 2,000 $cm^3$.

2. The plate of claim 1, wherein one or more of the thermally sprayed layers further comprise oxide of Group 3B metal element.

3. The plate of claim 1, wherein one or more of the thermally sprayed layers comprise 30-90 weight % rare earth oxide.

4. The plate of claim 1, wherein one or more of the thermally sprayed layers comprise 30-80 weight % rare earth oxide.

5. The plate of claim 1, wherein the plate has a thickness in the range from 1.2 mm to 4 mm.

6. The plate of claim 1, wherein the rare earth oxide is yttrium oxide.

7. The plate of claim 1, wherein the rare earth oxide is erbium oxide.

8. The plate of claim 1, wherein the plate has a volume of 100 to 1,000 $cm^3$.

9. A method for preparing a plate according to claim 1, comprising thermally spraying a rare earth-based oxide on a support to form a coating having a thickness from 1.2 mm to 5 mm, and peeling the sprayed coating from the support.

10. The method of claim 9 wherein the support comprises carbon.

11. The method of claim 9 wherein the peeling step is spontaneous peeling.

12. The method of claim 9, wherein the sprayed coating peeled from the support has an inner surface as peeled from the support and an outer surface remote therefrom, and the method further comprises the step of thermally spraying a rare earth-based oxide on the inner and/or outer surface of the sprayed coating.

13. A method for preparing a laminate, comprising thermally spraying a metal or metal compound on a surface of the sprayed plate obtained by the method of claim 9.

14. A laminated plate consisting of:

one or more thermally sprayed layers comprising 30 weight % or more rare earth oxide having a thickness at least 1.2 mm; and one or more thermally sprayed layers of metal or metal compound having a thickness at least 0.7 mm, wherein the laminated plate has a thickness from 1.9 mm to 5 mm and a warpage of less than 0.5 mm, having a shape selected from the group consisting of tetragonal, pentagonal and polygonal shapes, disc shapes, elliptic shapes, triangular shapes, and rings of these shapes having a center opening, and having a volume of 50 to 2,000 $cm^3$.

15. The laminated plate of claim 14, wherein one or more of the thermally sprayed layers further comprise oxide of Group 3B metal element.

16. The laminated plate of claim 14, wherein one or more of the thermally sprayed layers comprise 30-90 weight % rare earth oxide.

17. The laminated plate of claim 14, wherein one or more of the thermally sprayed layers comprise 30-80 weight % rare earth oxide.

18. The laminated plate of claim 14, wherein the laminated plate has a thickness in the range from 1.9 mm to 4 mm.

19. The plate of claim 14, wherein the laminated plate has a volume of 100 to 1,000 $cm^3$.

20. A plate consisting of one or more thermally sprayed layers comprising 30 weight % or more rare earth oxide, wherein the plate has a thickness from 2.0 mm to 5 mm and a warpage of less than 0.5 mm, wherein the plate has a shape selected from the group consisting of tetragonal, pentagonal and polygonal shapes, disc shapes, elliptic shapes, triangular shapes, and rings of these shapes having a center opening, and having a volume of 50 to 2,000 $cm^3$, wherein the plate was obtained by thermally spraying a rare earth-based oxide on a support and peeling the sprayed coating from the support.

21. The plate of claim 20, wherein the plate was obtained by thermally spraying a rare earth-based oxide on a carbon support and peeling the sprayed coating from the support.

* * * * *